US011377344B1

(12) United States Patent
Nelson, III

(10) Patent No.: US 11,377,344 B1
(45) Date of Patent: Jul. 5, 2022

(54) METHOD OF REPAIRING A CUSHION, IN PARTICULAR, METHOD OF REPAIRING A CUSHION USING AN INSERT

(71) Applicant: William M. Nelson, III, Columbus, MS (US)

(72) Inventor: William M. Nelson, III, Columbus, MS (US)

( * ) Notice: Subject to any disclaimer, the term of this patent is extended or adjusted under 35 U.S.C. 154(b) by 332 days.

(21) Appl. No.: 16/826,894

(22) Filed: Mar. 23, 2020

(51) Int. Cl.
*B68G 7/06* (2006.01)
*A47C 27/18* (2006.01)
*A47G 9/10* (2006.01)

(52) U.S. Cl.
CPC ..... *B68G 7/06* (2013.01); *A47C 27/18* (2013.01); *A47G 9/1027* (2013.01); *A47G 9/10* (2013.01)

(58) Field of Classification Search
CPC .. B68G 7/06; A47C 27/18; A47C 7/38; A47C 7/383; A47C 7/40; A47G 9/10; A47G 9/1027
USPC ..... 29/91.1; 5/640, 644, 654, 655.3, 659
See application file for complete search history.

(56) References Cited

U.S. PATENT DOCUMENTS 1,382,596 A 6/1921 Doll
2,942,281 A * 6/1960 Cole ..... A47G 9/10 5/644
3,310,613 A 3/1967 Lundberg
4,501,034 A * 2/1985 Greenawalt ..... A47G 9/10 5/636
4,655,505 A 4/1987 Kashiwamura et al.
4,707,027 A 11/1987 Horvath et al.
4,745,645 A * 5/1988 McWilliams ..... A47C 21/06 5/660
4,984,315 A * 1/1991 Ortman ..... A47C 20/025 5/631
5,048,167 A * 9/1991 Heffley ..... A47C 27/063 29/402.11
5,069,837 A * 12/1991 Sember, III ..... B29C 44/583 264/45.2
5,231,720 A * 8/1993 Benoff ..... A47C 27/18 5/644
6,622,326 B2 * 9/2003 Richardson ..... A47C 27/081 5/636
6,665,898 B2 * 12/2003 Gordon ..... A47C 21/06 5/659
7,373,678 B2 5/2008 Hetzel et al.
8,205,282 B2 * 6/2012 Brogan ..... A47G 9/1081 5/636
8,782,834 B2 * 7/2014 Berg ..... A47G 9/1027 5/639
8,850,647 B2 * 10/2014 Hitch ..... A47C 27/18 5/709
9,101,234 B2 * 8/2015 Berg ..... B68G 7/12
9,314,118 B2 * 4/2016 Blazar ..... A47G 9/1027
9,661,935 B2 * 5/2017 Maggard ..... A47C 7/20
2003/0014819 A1 * 1/2003 Richardson ..... A47G 9/1027 5/644

(Continued)

*Primary Examiner* — Robert G Santos
(74) *Attorney, Agent, or Firm* — Shlesinger, Arkwright & Garvey LLP

(57) ABSTRACT

Method of repairing a seat cushion; and, in particular, method of repairing a flattened seat cushion having a fill which has been compressed over time, for example. Method of repairing a seat cushion include providing a cushion having a flattened fill, opening the cushion, removing the flattened fill, providing an inflatable insert, and inflating the inflatable insert to fill the cushion.

17 Claims, 1 Drawing Sheet

(56) References Cited

U.S. PATENT DOCUMENTS

| | | | | |
|---|---|---|---|---|
| 2003/0101515 | A1* | 6/2003 | Gordon | A47C 27/082 5/659 |
| 2005/0172412 | A1* | 8/2005 | Pearson | A47C 27/10 5/659 |
| 2006/0117486 | A1* | 6/2006 | Clark | A47C 21/06 5/659 |
| 2009/0235460 | A1* | 9/2009 | Hitch | A47C 27/18 251/294 |
| 2012/0036642 | A1* | 2/2012 | Brogan | A47G 9/1081 5/644 |
| 2013/0019409 | A1* | 1/2013 | Blazar | A47G 9/1027 5/644 |
| 2013/0269111 | A1* | 10/2013 | Berg | A47G 9/1027 112/475.08 |
| 2014/0325762 | A1* | 11/2014 | Berg | B68G 7/12 5/644 |
| 2016/0296032 | A1* | 10/2016 | Maggard | A47C 7/20 |

* cited by examiner

METHOD OF REPAIRING A CUSHION, IN PARTICULAR, METHOD OF REPAIRING A CUSHION USING AN INSERT

FIELD OF THE INVENTION

The invention relates to a method of repairing a cushion. More particularly, the invention relates to a method of repairing a cushion using an insert.

BACKGROUND OF THE INVENTION

Cushions, such as cushions used on couches and chairs exist.

OBJECTS AND SUMMARY OF THE INVENTION

The invention relates to a method of repairing a seat cushion; and, in particular, to a method of repairing a flattened seat cushion having a fill which has been compressed over time, for example.

The method of repairing a seat cushion according to the invention further includes providing a cushion having a flattened fill, opening the cushion, removing the flattened fill, providing an inflatable insert, and inflating the inflatable insert to fill the cushion. The cushion may be opened by unzipping a zipper on the cushion, or by slitting the cushion to remove the flattened fill if the cushion has no zipper.

The method of repairing a cushion according to the invention further includes that the inflatable insert has a valve.

The method of repairing a cushion according to the invention further includes the inflatable insert has the shape of a polyhedron.

The method of repairing a cushion according to the invention further includes the inflatable insert Has the shape of a wedge.

The method of repairing a cushion according to the invention further includes that the inflatable insert has the shape of a cylinder.

The method of repairing a cushion according to the invention further includes that the inflatable insert has the shape of a right cylinder.

The method of repairing a cushion according to the invention further includes that the inflatable insert has the shape of a six-sided cylinder.

The method of repairing a cushion according to the invention further includes that the flattened fill is partially removed.

The method of repairing a cushion according to the invention further includes that the flattened fill is substantially completely removed and substantially no remainder of the flattened fill is left.

The method of repairing a cushion according to the invention further includes that the inflatable insert fills the cushion to its original configuration when the inflatable insert is inflated.

The method of repairing a cushion according to the invention further includes that the cushion Is a seat cushion.

The method of repairing a cushion according to the invention further includes that the cushion is a backrest cushion.

The method of repairing a cushion according to the invention further includes that the cushion is closed after the inflatable fill is inserted.

The method of repairing a cushion according to the invention further includes that the cushion is closed using needle and thread.

The method of repairing a cushion according to the invention further includes that the cushion is closed by hand using needle and thread.

The method of repairing a cushion according to the invention further includes that the cushion is closed by a sewing machine using needle and thread.

Relative terms such as left, right, up, and down are for convenience only and are not intended to be limiting.

DETAILED DESCRIPTION OF THE INVENTION

Figure 1:
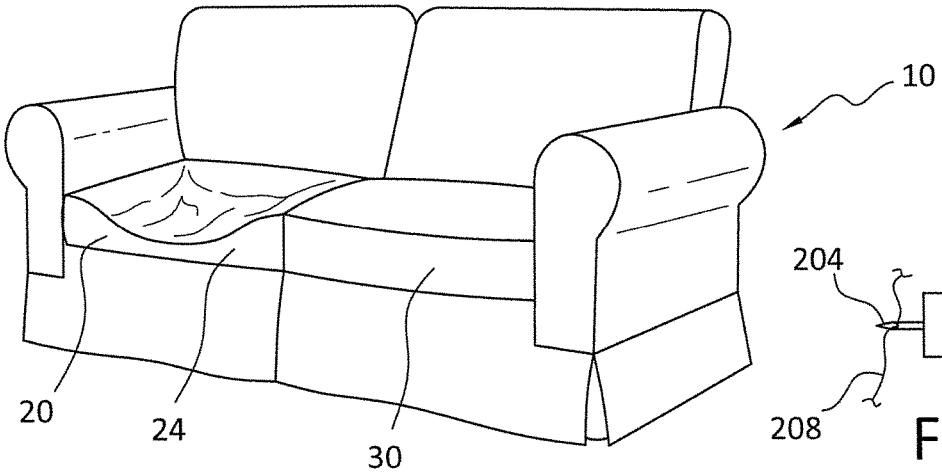
FIG. 1 is a perspective view of a couch having a flattened cushion to be repaired according to the invention.

As shown in FIG. 1, a couch 10 may have a flattened cushion 20 with a front face 24 and a top face 28. Cushion 20 may have been partially crushed given that repeated use caused a factory installed foam support inside cushion 20 to be crushed thanks to repeated use in a time period. That crushing will be described in greater detail below. A second cushion 30 may have retained its original shape and appearance, as shown, such as when second cushion 30 was subjected to less use during the time period in which cushion 20 was crushed. Couch 10 may have a backrest extending upwardly away from cushion 20 and cushion 30, as shown.

Figure 2:
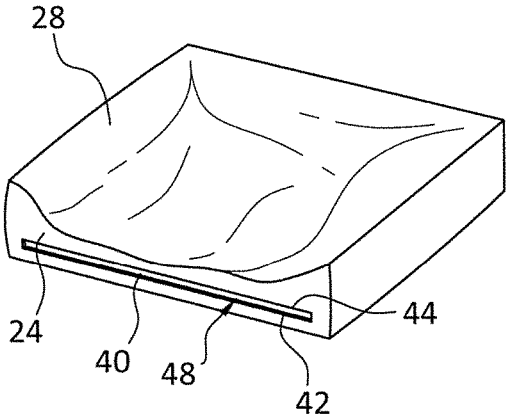
FIG. 2 is a perspective view of a flattened cushion having a flattened fill to be repaired according to the invention.

FIG. 2 shows how in a step according to the invention a slit 40 is made in face 24 of cushion 20. Slit 40 is made as cushion 20 has no zipper which may be opened. Top face 28 of cushion 20 may be bowed in, as shown. Slit 40 will have a bottom edge 42 and a top edge 44 defining an opening 48.

Figure 3:
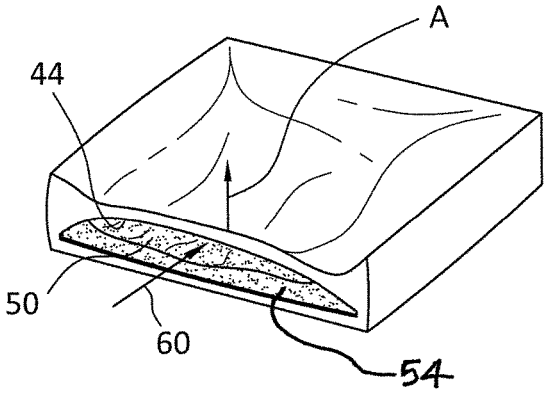
FIG. 3 is a perspective view of a flattened cushion being opened for repair according to the invention.
Figure 6:
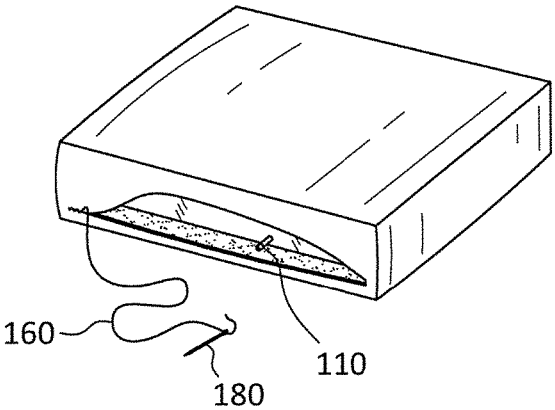
FIG. 6 is a perspective view of a cushion having an inflated insert during repair according to the invention.

FIG. 3 shows how top edge 44 is moved upwardly away in a direction of an arrow A from bottom edge 42 in order to enlarge opening 48 in face 24. A flattened fill 50 may be seen through opening 48. Flattened fill 50 may be made a foam fill or may be another material. Flattened fill 50 may be partially removed and leave a remainder 54 as best seen in FIG. 3; Or, flattened fill 50 may be completely removed as shown in FIG. 6. An arrow 60 shows a direction of insertion of an insert 100 through opening 48 into flattened cushion 20.

Figure 4:
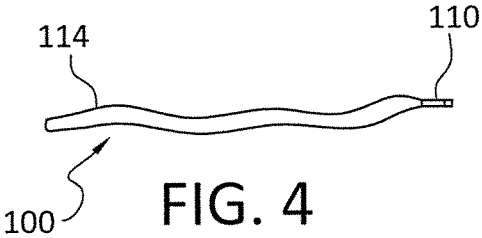
FIG. 4 is a side view of a flattened insert for use during repair according to the invention.

FIG. 4 shows insert 100 with a valve 110 for use in filling insert 100 with a gas, such as air. Insert 100 is shown in a flat uninflated state 114.

Figure 5:
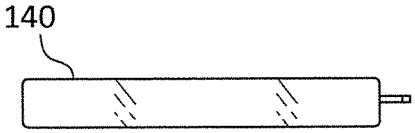
FIG. 5 is a side view of an inflated insert for use during repair according to the invention.

FIG. 5 shows insert 100 in a filled state 140. Filled state 140 may be achieved by sending a gas through valve 110 in order to fill insert 100, as will be readily appreciated.

Insert 100 will be placed or inserted into cushion 20 being repaired, as shown in the direction of arrow 60 of FIG. 3. Insert 100 may be provided adjacent partially removed flatted fill 50. As shown in FIG. 6 insert 100 may be adjacent top face 28. If cushion 20 is turned over, then the top face would be, in effect, a bottom face of cushion 20. After insertion, insert 100 will be inflated to raise top face 28 a desired amount by using valve 110 in order to repair flattened cushion 20. Insert 100 may be filled after insert 100 has been inserted into cushion 20 in direction 60.

Then, as shown in FIG. 6, repair of flattened cushion 20 may be completed by closing slit 40. Closing may be by a user sewing bottom edge 42 and top edge 44 together by using a thread 160 and a needle 180. That using of thread 160 and needle 180, may be done manually, as shown.

Figure 7:
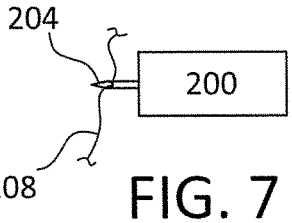
FIG. 7 is a schematic view of a sewing machine which may be used during repair according to the invention.

Closing of slit 40 may likewise be achieved by using a sewing machine 200 having a sewing needle 204 and a thread 208 as shown in FIG. 7.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A method of repairing a cushion, comprising:

a) providing a cushion having a flattened fill forming a bowed in top face of the cushion;

b) opening the cushion;

c) partially removing the flattened fill and leaving a remainder of the flattened fill;

d) providing an inflatable insert;

e) inserting the inflatable insert in the cushion; and f) inflating the inflatable insert to fill the cushion to raise the top face.

2. The method of repairing a cushion according to claim 1, wherein:

a) the inflatable insert has a valve.

3. The method of repairing a cushion according to claim 1, wherein:

a) the inflatable insert includes an insert which has the shape of a polyhedron.

4. The method of repairing a cushion according to claim 1, wherein:

a) the inflatable insert includes an insert which has the shape of a wedge.

5. The method of repairing a cushion according to claim 1, wherein:

a) the inflatable insert includes an insert which has the shape of a cylinder.

6. The method of repairing a cushion according to claim 1, wherein:

a) the inflatable insert includes an insert which has the shape of a right cylinder.

7. The method of repairing a cushion according to claim 1, wherein:

a) the inflatable insert includes an insert which has the shape of a six-sided cylinder.

8. The method of repairing a cushion according to claim 1, wherein:

a) the inflatable insert is inserted adjacent the remainder of the flattened fill.

9. The method of repairing a cushion according to claim 1, wherein:

a) the flattened fill is substantially completely removed and substantially no remainder of the flattened fill is left.

10. The method of repairing a cushion according to claim 1, wherein:

a) the inflatable insert fills the cushion to its original configuration when the cushion is inflated.

11. The method of repairing a cushion according to claim 1, wherein:

a) the cushion includes a seat cushion.

12. The method of repairing a cushion according to claim 1, wherein:

a) the cushion includes a backrest cushion.

13. The method of repairing a cushion according to claim 1, wherein:

a) the cushion is closed after the inflatable insert is inserted.

14. The method of repairing a cushion according to claim 13, wherein:

a) the cushion is closed using needle and thread.

15. The method of repairing a cushion according to claim 14, wherein:

a) the cushion is closed by hand using needle and thread.

16. The method of repairing a cushion according to claim 14, wherein:

a) the cushion is closed by a sewing machine using needle and thread.

17. The method of repairing a cushion according to claim 9, wherein:

a) the inflatable insert is inserted adjacent the remainder of the flattened fill.

* * * * *